US005560054A

United States Patent [19]

Simon

[11] Patent Number: 5,560,054

[45] Date of Patent: Oct. 1, 1996

[54] STORABLE PATIENT LIFT AND TRANSFER APPARATUS

[75] Inventor: William H. Simon, 1313 Partridge La., Villanova, Pa. 19085

[73] Assignee: William H. Simon, Villanova, Pa.

[21] Appl. No.: 291,407

[22] Filed: Aug. 16, 1994

[51] Int. Cl.[6] ..... A61G 7/10

[52] U.S. Cl. ..... 5/86.1; 5/83.1; 5/87.1

[58] Field of Search ..... 5/86.1, 81.1, 83.1, 5/87.1, 84.1, 85.1; 212/264

[56] References Cited

U.S. PATENT DOCUMENTS

| | | | |
|---|---|---|---|
| 3,999,228 | 12/1976 | Thomas | 5/83.1 |
| 4,484,366 | 11/1980 | Koontz . | |
| 4,644,595 | 2/1984 | Daniel | 5/83.1 |
| 4,712,257 | 12/1987 | Jones . | |
| 4,727,995 | 3/1988 | Louw | 212/264 X |
| 5,064,921 | 2/1992 | Hicks . | |
| 5,077,844 | 1/1992 | Twitchell . | |
| 5,117,516 | 2/1992 | Penner | 5/86.1 |
| 5,165,123 | 11/1992 | Colpron | 5/86.1 X |
| 5,185,895 | 2/1993 | Gagne . | |
| 5,211,297 | 5/1993 | Vandervalk | 212/264 X |
| 5,365,621 | 11/1994 | Blain | 5/81.1 |
| 5,379,468 | 1/1995 | Cassidy et al. | 5/86.1 |
| 5,388,289 | 2/1995 | Casperson | 5/86.1 |
| 5,412,820 | 5/1995 | Richards | 5/86.1 |

*Primary Examiner*—Steven N. Meyers
*Assistant Examiner*—Monica E. Millner
*Attorney, Agent, or Firm*—McHale & Slavin, P.A.

[57] ABSTRACT

A portable lifting apparatus for lifting and transferring of patients for use in combination with a sling or the like support. The apparatus is stored in a retracted state by placement of supporting legs and the lifting boom in a folded position. The apparatus can be placed into an operating position in less than two minutes by extension of the support legs and lifting boom which are then locked into position by the use of over-center latches used on leg struts and a boom crutch. Extension is verified by the use of LED indicator lights located on a control panel providing operational sequences from a single location. Separate motors are provided for placement of the legs and boom as well a hoist motor for operating a hoist and a swing motor for angular placement of the boom unit. In a retracted state the apparatus can be stored in a small area such as a closet having a footprint no larger than the size of the base frame. Portability is provided by lockable wheels positioned beneath the frame which can be used in conjunction with hand brakes for braking purposes.

20 Claims, 3 Drawing Sheets

STORABLE PATIENT LIFT AND TRANSFER APPARATUS

BACKGROUND OF THE INVENTION

1. Field of the Invention

This invention relates generally to hoisting equipment and more particularly, to a portable lifting apparatus for lifting and transferring incapacitated persons.

2. Background Information

It is well known that persons confined to a bed due to illness, age, and so forth possess such limited mobility that movement or transfer is extremely difficult. Improper transfer can result in serious complications to the individual. For instance, the need to move a patient immediately after an operation is necessary yet a dangerous proposition as any movement of the body may undo the surgeon's most careful work. Just as important is the need to transfer a bed ridden person for bathing or exercise so as to facilitate recovery.

In a hospital setting, a transfer is typically performed by a number of hospital workers in order to comfortably lift a patient from one position to another. If the transfer is made only by hand, the hospital personnel risk injury to their backs. If the transfer utilizes too few personnel or requires reaching in an awkward position, the personnel may strain their own bodies. Despite the number of personnel employed to assist in the transfer, the patient is simply susceptible to injury from anyone who touches or lifts incorrectly.

For these reasons, a number of devices are presently available for lifting and lowering of incapacitated persons from a bed, chair, bath or the like position. U.S. Pat. No. 5,185,895, issued to Gagne, sets forth a patient lift device consisting of a base frame having vertically oriented guideposts wherein a carriage assembly moves along the guideposts in response to an operator applied control signal. An arm assembly projects over the person who is placed into a sling for lifting. The patent discloses a basic lift and transferring apparatus of the prior art. The problem with such a device is the size necessary in order to accomplish the intended service. In particular, the prior art device employs elongated legs and a boom which is necessary to lift a patient. This prevents the device from being easily transferred or stored. The length of the components are necessary so that the apparatus can fit beneath a bed or chair yet provide sufficient support during the lifting process.

Thus a primary problem with the instant apparatus, as well as the remainder of the known prior art, is that the support and lifting structure must be sized adequately in order to support the lifting of the patient. However, the structure interferes with transportation and storage of the device. Since all components in the prior art remain in an extended position, they may cause a person to trip or run into the device. Such a device is difficult to transport and store for the legs and boom remain in an outward position.

U.S. Pat. No. 5,084,921 is another example of a patient lift and transfer apparatus having a unitary frame which consists of a caster wheel equipped U-shaped horizontal disposed frame. The invention discloses a unique vertically disposed pivotally biased arm to lift a patient supporting sling for moving a patient. Again the legs of this apparatus are capable of being placed beneath a patient's bed providing sufficient support for the lifting apparatus as well as the patient. However, no provision is made for storage or transportation of the apparatus.

U.S. Pat. No. 4,712,257 is still another patient lift device consisting of a lifting arm and sling hanger supported by a rigid frame having a U-shaped base structure using wheels for ease of frame movement. The invention further discloses the use of a sling having spaced apart attachment points for use in combination with a vertical bearing to prevent swinging movement of a patient placed within the sling.

U.S. Pat. No. 5,077,844 sets forth an apparatus for lifting and moving patients wherein the frame is permanently attached to a fixed structure. This apparatus eliminates the need for legs but limits the use to non-portable placement.

U.S. Pat. No. 4,484,366 sets forth a patient transfer device which again relies upon the use of a fixed base which fits beneath the patient's chair or bed making the unit impractical to store in a compact position. U.S. Pat. No. 5,185,895 discloses an apparatus for lifting patients and transporting them. The apparatus is based upon electrical motors to provide assistance in patient movement wherein the arm members can telescope and then retract. This apparatus does not teach the retraction of the arms for purposes of storage or transportation.

Thus, there is a need for a lifting and transferring apparatus which is simple to operate and retracts into a compact position to permit ease of storage and transportation of the apparatus.

SUMMARY OF THE INVENTION

The present invention satisfies this need through provision of a retractable lifting apparatus. The apparatus meets the particular problems commonly found in hospitals and convalescent homes where short term lifting capabilities are necessary. Unique to this invention is the ability to lift over five hundred pounds yet retract in size for purposes of transporting and storage. In operation the support legs provide an eighty inch stance. In a retracted position, the support legs are pivoted upward leaving a frame footprint of approximately thirty inches. The invention consists of a miniature crane comprising a boom with a hoist mounted at the end of the boom. The boom is coupled to the portable frame and held in its operating horizontal position by a collapsible crutch allowing the boom to fold over into a nearly vertical position. An electric motor driven linear actuator makes extension and retraction of the boom effortless and a solenoid is used to pull the over-center hinge of the crutch to allow folding.

Similarly, support legs extend outwardly from the frame and are locked in position by a collapsible strut. Both the boom crutch and the leg strut each use over-center lockable hinges with confirming LED's that illuminate to verify the position of the components as well as the locked or stored position. For storage a leg hoist is used to retract a cable, by a pivotal motion, lifting the legs to an upright position after a solenoid pulls the over-center hinge of the strut to allow folding.

Once the apparatus is in a retracted position the unit can be easily moved by unlocking frame mounted wheels. In a preferred embodiment the apparatus uses five wheels, four of which are lockable caster wheels similar to those found on stretchers. Hand brakes on the frame provide a means for stopping the unit from rolling during transporting. In an alternative embodiment, the hand brakes must be depressed in order to release the wheels thus eliminating the need for separate wheel locks.

In the extended position, an operator can maneuver the hoist over a patient's bed wherein a hook is available for attaching to a patient sling. The sling is placed beneath the patient so as to facilitate support during transfer. The hoist is capable of lifting up to five hundred pounds and the boom has an angular range of motion of approximately forty degrees with a twenty degree extension tolerance. Movement of the boom in a angular rotation is performed by use of an electric motor.

A simplified control panel is provided for operation of all moving components and consists of a resilient ball that is free swinging and easily accessible by the operator despite their position. On one side of the control mechanism is the boom and leg controls, depression of which will allow the motors to fully extend the components for operation. The LED's will blink and light either as red or green depending upon status of component placement. Located on the opposite side of the control panel are operation switches for moving the hoist upward or downward and the angular movement of the boom. Indicator lights are provided to illuminate if the equipment is in operation.

Thus, an objective of the instant invention is to provide a patient lift device or apparatus that is simple to operate and employs retractable components so as to permit storage in a closet or transportation through doorways.

Yet another objective of the instant invention is to disclose the use of collapsible struts with confirming indicator lights for support of load bearing and stability components.

Yet still another objective of the instant invention is to provide a device that can be operated by a single person and is easily moveable in confined areas such as those found in a hospital or convalescent home.

Still another objective of the instant invention is to teach the use of brakes for stopping or locking the wheels of portable lift equipment.

Another objective of the instant invention is to provide a lifting apparatus that can be placed into operation, from a stored condition, in less than two minutes. The extending components geared so as to meet this time frame yet provide a mode of extension that is stable for use in fragile environments.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
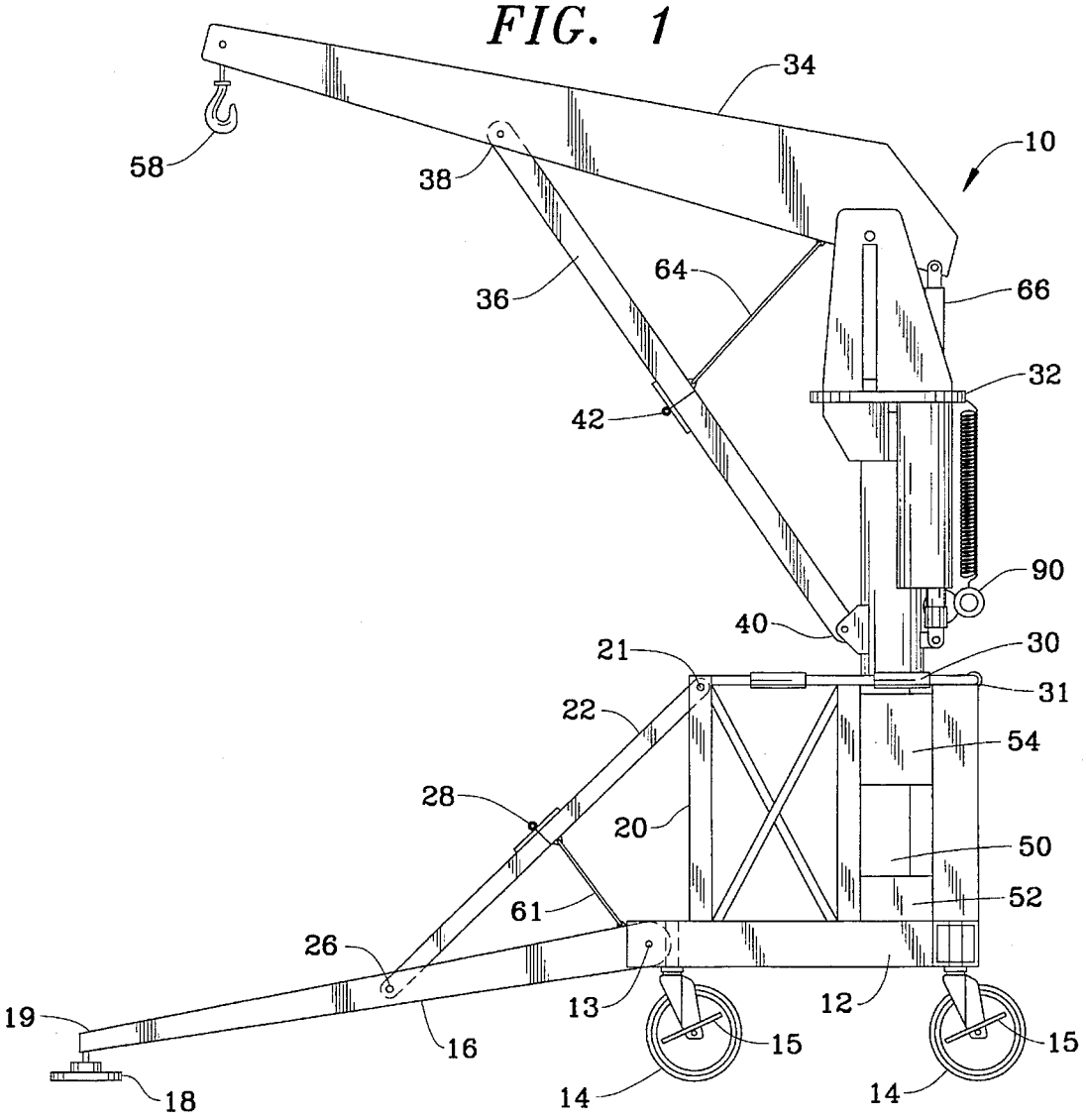
FIG. 1 is a side plane view of the instant invention in an operating position.

Now referring to FIG. 1, shown is the preferred embodiment of the instant invention 10 comprising a base frame 12 having five wheels 14 secured to the bottom of said frame 12. Wheels 14 are placed around the perimeter of the base frame 12 and preferably have a central locking and steering ability similar to conventional stretchers wherein they can be fully locked, locked to roll straight ahead, or free wheel. In such an embodiment, two levers, not shown, are mounted on each end of the frame 12. One lever locks two wheels at that end forcing the united to roll straight ahead for optimum steering. The back wheels pivot free for steering purposes. Alternatively, foot operate levers 15 provide simplified engagement of the wheel locks.

Pivotally mounted to an end 13 of the base frame 12 is a first leg 16 having a shoe plate 18 mounted at a distal end 19 of the leg 16. Structure 20 provides a support housing for electric motors used for operating the components as well as an upper articulating point 21 for the legs 16 and 16A. A first strut 22 is pivotally coupled to said upper articulating point 21 and to the illustrated leg 16 at lower pivot point 26. The strut 22 utilizes a centrally disposed over-center hinge 28 which folds inward so as to allow the leg 16 into a vertical stance for purposes of storage. To retract the legs, motor 50 is mechanically linked to the legs 16 and 16A and boom motor 52 provides retraction of the boom 34 in a similar manner. A hoist motor 54 provides the lifting and lowering of the hook 58, and a swing motor 56 is used to modulate the angular arc of the boom 34.

The support frame 20 includes hand grips 30 placed along an upper rail 31 providing an operator with a predetermined position for moving of the lifting device. The handgrips 30 can be accompanied by hand brakes, not shown, for use in preventing wheel 14 rotation. In such an embodiment, the operator can prevent movement of the unit by simply squeezing a hand brake in a similar fashion as a brake used on a bicycle. Once stopped, the apparatus can be locked in position through the use of the aforementioned wheel locks 15.

An alternate embodiment is to use hand grips that apply constant braking force so as to require the operator to maintain their hands on the apparatus during transportation. This is especially useful in those circumstances where a ramp is encountered during transportation. In such an embodiment, should a unit free roll down a ramp the brakes will engage to bring the unit to a stop.

Boom head 32 is supported by the frame 20 and is shown in its extended position. Extension of the boom 34 is made possible by an electric motor driven linear actuator 66 which extends crutch 36 which is coupled to the boom 34 by upper pivot point 38 and lower pivot point 40. The centrally disposed hinge 42 is forced over-center by the linear actuator causing said hinge to lock in a fixed position. Storage of the boom occurs by folding of the boom 34 downward by allowing the boom 34 to fold within the confines of the frame 20 by reversal of the above steps. Similarly, the legs 16 are folded upward by the inward movement of the strut hinge 28 so as to provide a compact unit that stores in a small closet and can be maneuvered through doorways. An additional cable runs parallel to strut 22 and when said cable is pulled in by the leg motor, after the solenoid releases the over-center hinge, the leg folds to the near vertical position.

Figure 2:
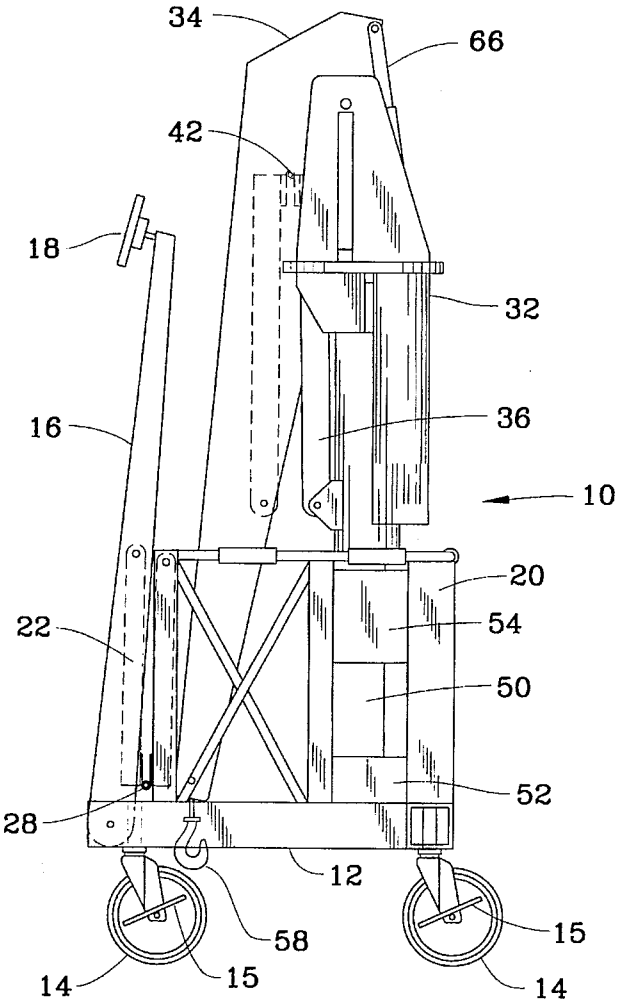
FIG. 2 is a side plane view of the instant invention in a retracted position.

Now referring to FIG. 2, shown is the lifting device 10 in a retracted position wherein the base frame 12 provides the footprint for the structure 20 made portable by the wheels 14. The boom 34 is shown in its downwardly folded position while the legs 16 are shown in an upwardly folded position, all within the confines of the support structure 20. As depicted by this view, the crutch 36 is hinged 42 at a center point allowing the boom 34 to form a near vertical position thus eliminating the space necessary for a conventional hoisting unit and preventing the possibility of harm to an operator who inattentively walks into a fully extended boom. The over-center hinge is pulled from its locked state by use of a boom motor 52 which pulls the crutch cable 64, see FIG. 1, causing the crutch 36 to fold in the center. Linear actuator 66 operates to place the boom 34 in an extended or upright position.

Similarly, the legs 16 fold upright to maintain the unit's small storage footprint while further eliminating an unguarded leg extension common among those units in the industry, thus eliminating the possibility of injury to tripping an individual attempting to step over an extended support leg. The strut 22 is hinged 28 at a center point allowing the leg 16 to form a near vertical position. The over-center hinge is pulled from its locked state by use of a leg motor 50 which pulls the strut cable 61, see FIG. 1, causing the strut 22 to fold in the center. Gravity operates to bias the leg 16 into the extended position. A spring, not shown, can be incorporated in the leg to facilitate the biasing of the leg in an extended position.

Figure 3:
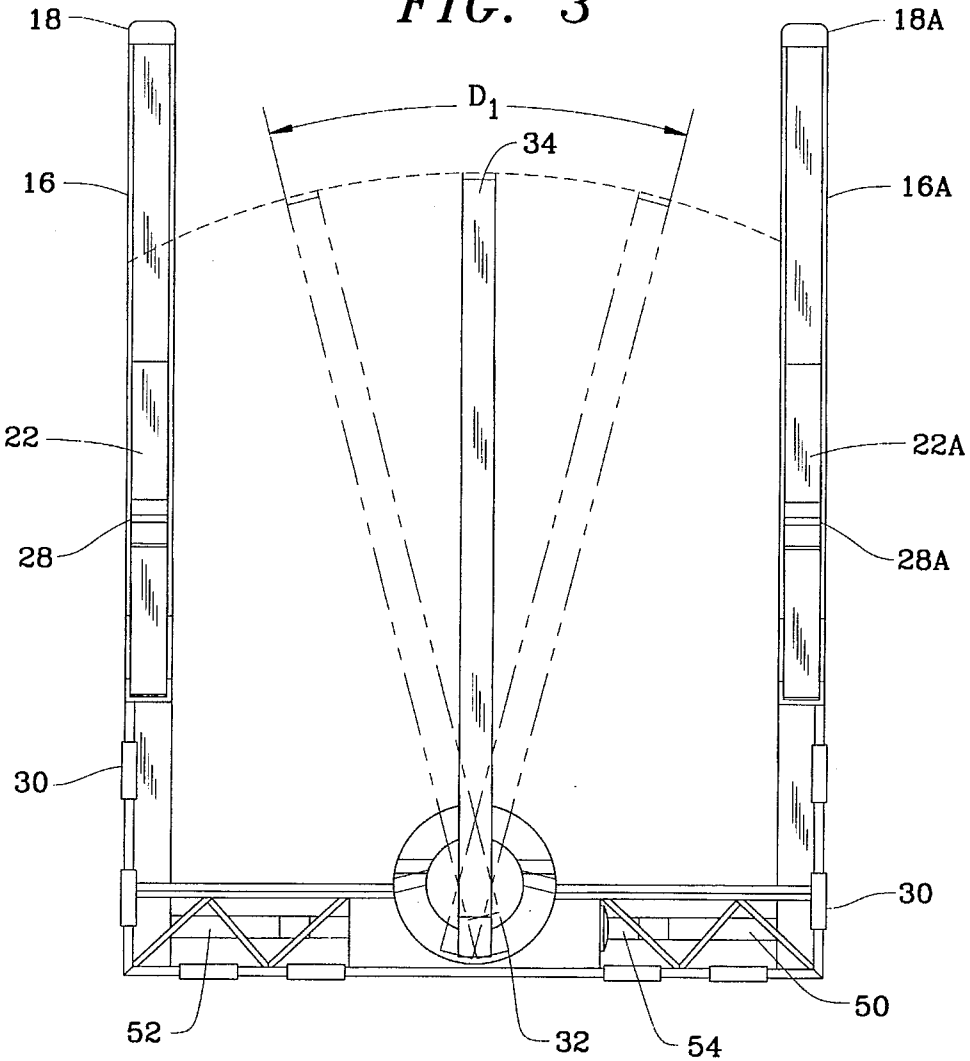
FIG. 3 is a top plane view.

FIG. 3 sets forth a top view of the instant device 10 in a fully extended form illustrating the wide U-shaped structure. Leg 16A operates in conjunction with leg 16 providing enhanced stability during operation. Each leg is raised and lowered by use of the same electric leg motor 50 so to operate in unison at all times. The leg support position is made possible wherein strut 22 and 22A is in a fully extended position allowing the strut hinges 28 and 28A to be locked in position forcing the shoe skid 18 and 18A to press against the floor. The stance provides stability for the boom 34 as it extends outward over the patient to be lifted.

In operation, the device 10 is moved into position so that the legs and boom 34 can extend without interference. As the unit is electrically powered, an AC cord is provided for insertion into an available wall socket to power the electrical motors, namely, the leg hoist 50, the hoist motor 52, the swing motor 54, and the boom motor linear actuator 66. Control of the system is performed by a control panel positioned in a hand held control ball fabricated from a three inch thick solid resilient ball as described later in this specification.

Placement of the leg and boom components in an operating position is accomplished by depressing a button on the control panel which simultaneously operates the leg motor 50 and boom motor linear actuator 66 allowing the legs 16 & 16A and the boom 34 to extend into their operating position. The operator may stop the extension procedure at any time should the legs or boom encounter interference. LED lamps are provided to represent the position of the legs and boom. The lamps will change from a blinking red color to a continuous green color when sensors, not shown, confirm a positive lock in the extended position similar to the indicators used with airplane landing gear.

The boom 34 has an angular sweep $D_1$ between legs 16 and 16A allowing the operator to pick up a patient at one position and transport the patient to a second position. Boom swing angle is approximately forty degrees with a twenty degree tolerance. The reach of the boom is sixty inches, slightly less than the preferred leg reach of approximately eighty inches. In operation it is recommended that a patient is placed upon a support sling wherein the boom 34 is swung over the patient in a lifting bar properly positioned over the support sling. This will minimize any swinging tendency as the support sling and patient is pulled upward. A hook 58 is located at the end of the boom 34. During this position the device 10 can be rolled slightly so as to facilitate correct positioning. Once the device 10 is properly located the wheels can be locked by use of the foot lever 15. A frame mounted lever, not shown, can be used to lock the wheels in a position allowing straight roll.

Using the control panel a button is provided to lower the hook 58 until the lifting assembly is attached. Raising the patient is performed by depressing a button on the control panel allowing upward movement so as the patient and sling are above both departure and arrival surfaces. The patient can then be swung from the departure surface to the arrival surface by provision of a right and left directional control button allowing movement of the boom 34. The patient is then unhooked from the hook 58 and the device 10 is positioned such that the legs 16 and boom 34 can be retracted without interference.

When the unit is to be transported or stored, a control button is provided so as to retract the legs and boom, the movement can be halted at any point if necessary. During the retraction the LED's representing the legs and the boom will blink red until sensors (not shown) detect a positive latch for storage. At that point, the LED's will stop blinking and be in a continuous red position. The device 10 can then be turned off and the AC cord unplugged and coiled for storage with the device 10.

Figure 4:
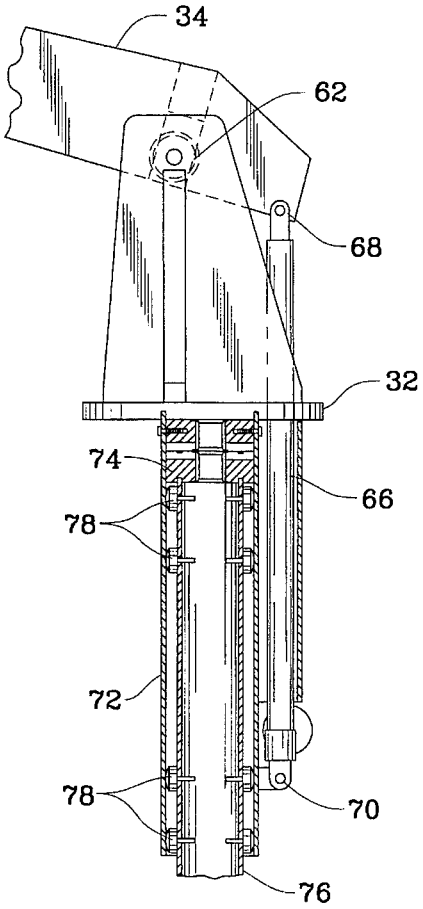
FIG. 4 is an enlarged partial cross-sectional side view of the boom head.

Referring to FIG. 4 the boom 34 is mounted on a rotatable boom head 32 that provides a pivot point 62 for one end of the boom 34 that is used in the retracted state. In particular the pivot point 62 allows the boom 34 to fold downward in a retracted position. The hinge 42 is an over-center hinge causing the crutch to lock into position. Collapsing of the boom requires that the hinge 42 is pulled off center by the cable 64 by a solenoid, not shown. The rotatable sleeve is manufactured from light weight aluminum having a five and a half inch diameter which is rotatably coupled to the frame 20 by a rotatable bearing 74 located at the bottom of the head 32 to allow rotation about a predetermined angle. The frame 20 incorporates a support post 76 which is placed on the inner side surface of the pipe 72 having a plurality of inwardly facing centering components which are plastic guides 78 maintaining a fixed distance between the head pipe 72 and the support post 76.

Figure 5:
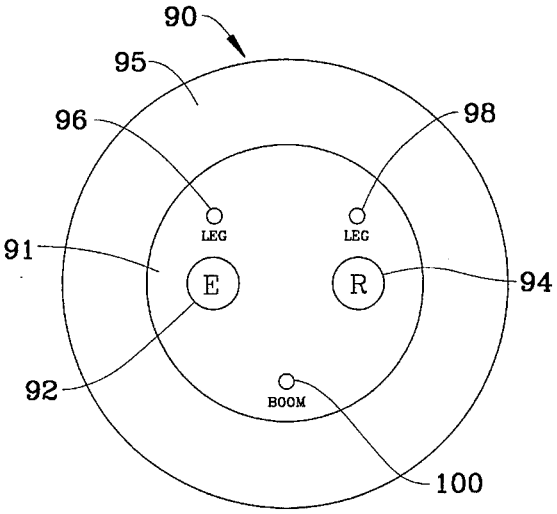
FIG. 5 is a front plane view of a control ball.

FIG. 5 illustrates a first side of the control system in its preferred embodiment comprising a hand held control ball 90 fabricated from a three inch diameter solid resilient ball. A control panel 91 is mounted in a recess 93 inside the ball 90 wherein a coiled cord, not shown, suspends the ball 90 at a convenient height for the operator to use. The rubber portion 95 of the ball 90 protects both the key pad 91 from damage and accidental button activation should the ball 90 swing free. Depressing of the control button 92 labeled "E" causes the legs and boom to extend so that the leg and boom actuator motor allow their respective latches to extend and lock into position. The leg motor is recommended to be geared to extend the legs at a linear speed at approximately 1 (one) inch per second. Optical sensors, such as Honeywell ultra thin reflective sensors are utilized to confirm that the legs have extended and locked before the hoist can be operated. The reflective sensors each contain an optical infrared emitting diode and a detector mounted in side by side converging optical axis. The detector responds to the radiant power only when a reflector object passes within the field of view. Similarly, the boom extends allowing the over-center hinge on the crutch to lock into position wherein the aforementioned optical sensor confirms the fully locked position by lighting of the LED lights for the legs 96, 98 and the boom 100. During retraction the retraction button 94 is depressed wherein the legs and the boom return to their retracted position and the LED lights 96, 98, and 100 illuminate to indicate the stored position.

Figure 6:
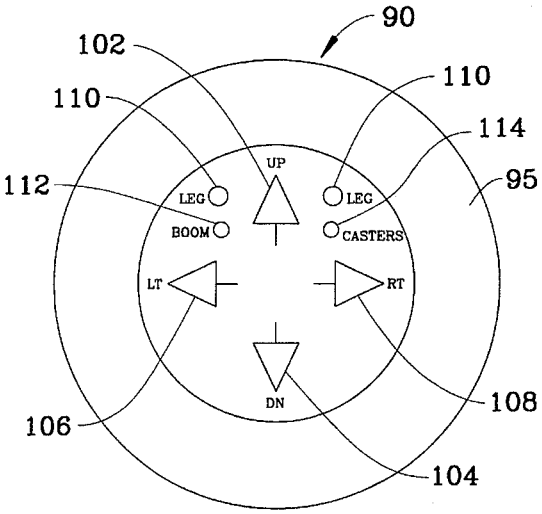
FIG. 6 is a back plane view of the control ball.

The back side of the control panel shown in FIG. 6 causes the hoist to move in the upward position by depressing of directional positioning switches. Depressing of an up switch 102 will operate the hoist motor for lifting of the hook. Depressing of a down switch 104 will operate the hoist motor for lowering of the hook. Movement of the boom to the left is accomplished by depressing the left switch 106 and movement of the hoist to the right is accomplished by depressing of the right switch 108. Lights are provided for indication of the leg 110 lock, boom 112 lock and wheel 114 lock. The hoist cable and pulleys should be rated for at least one-thousand pounds with a preferred linear cable speed of about 1 (one) inch per second. The hoist motor should be able to drive the cable reel via a worm gear thus the weight on the cable cannot cause the cable reel to rotate.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What I claim is:

1. An apparatus for lifting and transporting patients comprising:

a U-shaped base frame;

a plurality of wheels affixed to a lower portion of said base frame providing portability of said frame;

a first and second spaced apart leg support structure pivotally coupled to said lower portion of said base frame, each said leg support having a lockable strut coupled to an upper portion of said base frame for placing said legs in an operation;

means for retracting each said leg from a locked strut position to an upright storage position;

a boom rotatably coupled to said base frame, said boom having a lockable crutch coupled to said base frame for placing said boom in an operating position;

means for folding said boom from a lockable crutch position to a predetermined storage position;

lifting means operatively associated with said boom for raising and lowering of a patient.

2. The apparatus according to claim 1 wherein said lockable strut is further defined as a two piece collapsible metal support having a first and second end with a centrally disposed hinge, said first end pivotally coupled to said leg support and said second end pivotally coupled to said upper portion of said base frame, said support placed in a retracted position by the juxtapositioning of said first end to said second end.

3. The apparatus according to claim 2 wherein said hinge is an over-center hinge providing a rigid structure upon placement of said first and second end in a straight plane causing said hinge to lock in position.

4. The apparatus according to claim 1 including a means for determining strut position.

5. The apparatus according to claim 1 wherein said lockable crutch is defined as a collapsible metal support having a first and second end with a centrally disposed hinge, said first end pivotally coupled to said boom and said second end pivotally coupled to said upper portion of said base frame, said support placed in a retracted position by the juxtapositioning of said first end to said second end.

6. The apparatus according to claim 5 wherein said hinge is an over-center hinge providing a rigid structure upon placement of said first and second end in a straight plane causing said hinge to lock in a straight position.

7. The apparatus according to claim 1 including a means for determining crutch position.

8. The apparatus according to claim 1 wherein each said leg is further defined as a single piece structural metal beam pivotally coupled to said base frame at one end and having a shoe skid disposed at the other end.

9. The apparatus according to claim 1 wherein each said leg includes a first end and a second end which are connected by a hinge which is releasably controlled by a solenoid, and said means for retracting is a first electric motor mechanically linked to each leg, whereby after said solenoid releases said hinge said motor operates to pull said hinge and causes said first end and said second end of said strut to draw together, said motor providing a retracting speed of approximately 1 (one) inch per second.

10. The apparatus according to claim 1 wherein said means for folding is a second electric motor mechanically linked to said boom wherein operation of said motor after a solenoid places said hinge in an off-center position and causes said first end and said second end of said crutch to draw together, said motor providing a collapsing speed of approximately 1 (one) inch per second.

11. The apparatus according to claim 1 wherein said boom is biased in an operating position by a linear actuator.

12. The apparatus according to claim 1 wherein said boom is rotatable through an angular arc of approximately forty degrees with a twenty degree tolerance.

13. The apparatus according to claim 1 wherein said lifting means is further defined as a third electric motor mechanical link to a hook disposed at a distal end of said boom, said lifting means having a linear mechanical link speed of approximately 1 (one) inch per second.

14. The apparatus according to claim 12 wherein said boom is rotatable by use of a fourth electric motor.

15. The apparatus according to claim 14 wherein said mechanical link is defined as a stainless steel coated cable.

16. The apparatus according to claim 14 wherein said mechanical link is defined as a chain.

17. The apparatus according to claim 1 wherein said wheels can be locked.

18. The apparatus according to claim 17 wherein said wheels are locked in position by use of hand brakes located on said base frame.

19. An apparatus for lifting and transporting patients comprising:

a U-shaped base frame;

a plurality of wheels affixed to a lower portion of said base frame providing portability;

means for locking said wheels in a fixed position;

a first and second spaced apart leg support structure pivotally coupled to said base frame, each said leg support formed from a collapsible steel support having a first and second end with a centrally disposed over-center hinge, said first end pivotally coupled to said leg and said second end pivotally coupled to said upper portion of said base frame, said support placed in a retracted position by the juxtapositioning of said first end to said second end;

means for determining strut position;

a first electric motor mechanically linked to each strut hinge wherein operation of said motor in a retraction direction is performed by activation of a first solenoid to pull said hinge from a locked position allowing said first end and said second end of said strut to draw together for placing said legs in an upright stored position, reversing said motor places said legs in an operating position;

a boom rotatably coupled to an upper portion of said base frame, said boom having a collapsible steel support crutch with a first and second end and a centrally disposed over-center hinge, said first end pivotally coupled to said boom and said second end pivotally coupled to said upper portion of said base frame;

a second electric motor mechanically linked to said boom wherein operation of said motor in a retraction direction is performed by activation of a second solenoid to pull said hinge from a locked position causing the juxtapositioning of said first end and said second end, reversing said motor places said boom in an operating position;

means for determining crutch position;

a hoist operated by a third electric motor mechanically linked to a hook disposed at a distal end of said boom; and control panel for centralized operation of said first, second, and third motor.

20. The apparatus according to claim 19 wherein said control panel provides LED illumination of said boom and said leg positioning, said boom and leg positioning placed in a simultaneously extended position by depression of a first switch and placed in a simultaneously retracted position by depression of a second switch.

* * * * *